US010244789B2

(12) United States Patent
Austin

(10) Patent No.: US 10,244,789 B2
(45) Date of Patent: Apr. 2, 2019

(54) BEVERAGE CONTAINER ACCESSORY FOR AN ELECTRONIC VAPING DEVICE

(71) Applicant: Prince Devillmous Austin, Conyers, GA (US)

(72) Inventor: Prince Devillmous Austin, Conyers, GA (US)

( * ) Notice: Subject to any disclaimer, the term of this patent is extended or adjusted under 35 U.S.C. 154(b) by 0 days.

(21) Appl. No.: 15/603,268

(22) Filed: May 23, 2017

(65) Prior Publication Data

US 2017/0334606 A1 Nov. 23, 2017

Related U.S. Application Data

(60) Provisional application No. 62/340,073, filed on May 23, 2016.

(51) Int. Cl.

| | |
|---|---|
| ***A24F 9/14*** | (2006.01) |
| ***A24F 47/00*** | (2006.01) |
| ***A47G 19/22*** | (2006.01) |

(52) U.S. Cl.

CPC ..... *A24F 9/14* (2013.01); *A24F 47/002* (2013.01); *A47G 19/22* (2013.01)

(58) Field of Classification Search

CPC .... B65D 25/20; B65D 25/28; A47G 19/2205; A24F 47/002; A24F 9/14

USPC ..... 220/735, 696, 710.5, 741, 752–776

See application file for complete search history.

(56) References Cited

U.S. PATENT DOCUMENTS

| | | | | |
|---|---|---|---|---|
| 5,292,039 | A * | 3/1994 | Neofitou | G01F 11/263 222/158 |
| 5,325,982 | A * | 7/1994 | Cobb, Jr. | A47G 19/2222 215/228 |
| 5,671,503 | A * | 9/1997 | Uebelacker | A47G 19/2266 16/111.1 |
| 6,092,647 | A * | 7/2000 | Yeh | F23Q 2/32 206/217 |
| 6,179,259 | B1 * | 1/2001 | Schioldager | B65D 83/40 206/228 |
| 6,193,201 | B1 * | 2/2001 | Babcock | B65D 5/44 220/737 |
| 2009/0254030 | A1 * | 10/2009 | Sarraf | A61J 7/0053 604/77 |

* cited by examiner

*Primary Examiner* — Kareen K Thomas

(57) ABSTRACT

A liquid vessel which allows a user to mount and utilize an electric vaping device as a handle. The liquid vessel includes a beverage container, a handle bridge, and a mounting hole. The beverage container holds and dispenses liquid. The handle bridge receives the electric vaping device. The handle bridge is positioned offset form a base of the beverage container and is laterally connected to the beverage container. The mounting hole traverses through the handle bridge and is positioned parallel to a central axis of the beverage container. Additionally, the mounting hole is positioned offset from the beverage container in order to provide a clearance space for the electric vaping device. A tank system of the electric vaping device is positioned within the mounting hole and a battery case of the electric vaping device is mounted to the handle bridge.

11 Claims, 5 Drawing Sheets

BEVERAGE CONTAINER ACCESSORY FOR AN ELECTRONIC VAPING DEVICE

The current application claims a priority to the U.S. Provisional Patent application Ser. No. 62/340,073 filed on May 23, 2016.

FIELD OF THE INVENTION

The present invention relates generally to accessories for electronic vaping devices. More specifically, the present invention is a beverage container which allows a user to mount an electronic vaping device to the beverage container through a specialized handle.

BACKGROUND OF THE INVENTION

The present invention is a beverage container having a compartment that holds most electronic vaping device known as vapes. The present invention allows the user to utilize his or her electronic vaping device conveniently while drinking a beverage. In particular, the present invention is specifically designed to utilizes the electronic vaping device as the handle of the beverage container. The present invention is unique in several different ways. No other case for electronic vaping device integrates the electronic device into a cup that one can literally drink out of. The problem the present invention solves is for the user to do two things at once with one hand. The preferred embodiment of the present invention may utilize a seven-inch cup with a mounting mechanism which receives the electronic vaping device. The mounting mechanism includes a handle bridge and an adaptor. The handle bridge and the adaptor mount the electronic vaping device offset from the beverage container and allow the user to utilize the electronic vaping device as the handle of the beverage container. The present invention is meant for fun/cool/the new era. The preferred cup is simply a case for vapes.

DETAIL DESCRIPTIONS OF THE INVENTION

All illustrations of the drawings are for the purpose of describing selected versions of the present invention and are not intended to limit the scope of the present invention.

Figure 1:
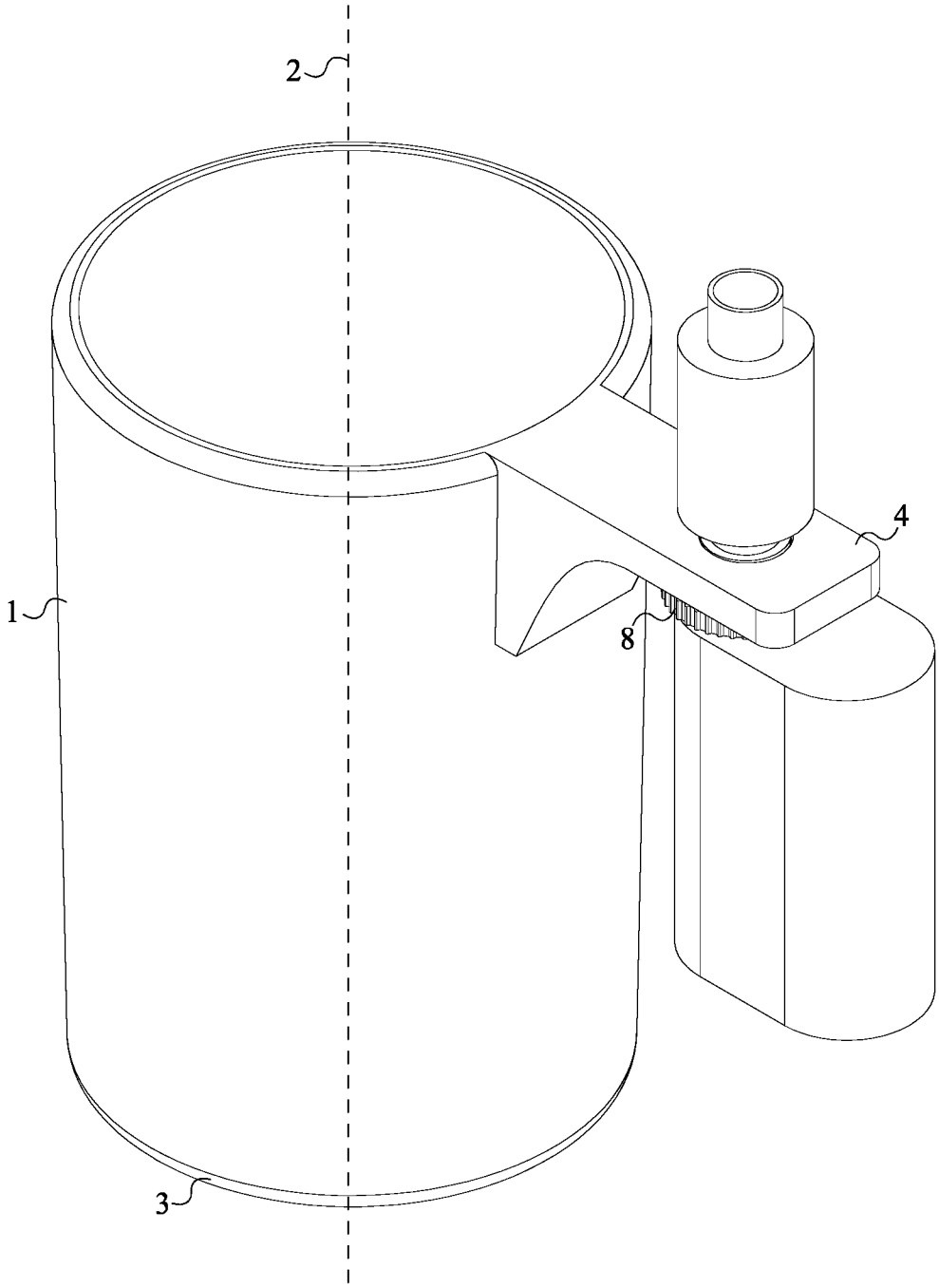
FIG. 1 is a perspective view of the present invention.

Referring to FIG. 1, the present invention comprises a beverage container 1, a handle bridge 4, and a mounting hole 5. The beverage container 1 is a vessel which holds and retains liquids for consumption. This provides the user with a means of consuming beverage liquids such coffee, soft drinks, and other similar liquids. More specifically, the beverage container 1 is a tubular body with a base 3. The tubular body acts as the lateral surface for the vessel. The base 3 closes off a bottom end of the tubular body. A variety of different type of cups/containers may be used as the beverage container 1 including, but not limited to, coffee cups, mugs, teacups, thermos, plastic bottles, and other similar cups. Additionally, the width, height, size, and material composition of the beverage container 1 may vary in order to accommodate the needs and preferences of the user. The handle bridge 4 acts as a mounting point for an electronic vaping device. Additionally, the handle bridge 4 acts as a grasping element of the present invention. The handle bridge 4 is preferably an elongated rectangular extrusion that is latterly connected to the beverage container 1. More specifically, the handle bridge 4 is positioned offset from the base 3 of the beverage container 1 and is laterally connected to the beverage container 1. Longitudinally propagating reinforcing strakes may be positioned in between the beverage container 1 and the handle bridge 4 in order to provide additional structural integrity to the handle bridge 4. Many variations and modifications to the handle bridge 4 are easily conceivable without departing from the spirit or scope of the present invention The mounting hole 5 receives the electronic vaping device and allows the user to utilize the electronic vaping device as the handle of the beverage container 1. As such, the mounting hole 5 traverses through the handle bridge 4 and is positioned parallel to a central axis 2 of the beverage container 1. This orients the electronic vaping device along the beverage container 1 and, thus, positions a mouthpiece of the electronic vaping device directly to a main opening of the beverage container 1. Resultantly, the user may easily and quick switch between drinking liquid and smoking the electronic vaping device. To ensure that the electronic vaping device does not touch or press up against the beverage container 1, the mounting hole 5 is positioned offset from the beverage container 1. This provides enough clearance for the electronic vaping device when the electronic vaping device is mounted to the handle bridge 4.

In the preferred embodiment of the present invention, the electronic vaping device is mounted to the handle bridge 4 through an internal threaded portion 7 and a coupling adaptor 8. The internal threaded portion 7 is a helical thread which receives the coupling adaptor 8. More specifically, the internal threaded portion 7 is positioned within the mounting hole 5. Additionally, the internal threaded portion 7 is laterally connected to the handle bridge 4, about the mounting hole 5. The coupling adaptor 8 attaches to the handle bridge 4, within the mounting hole 5, and receives the electronic vaping device. The coupling adaptor 8 comprises a cylindrical body 9, a first threaded hole 10, a first threaded shaft 11, and an external threaded portion 12. The first threaded hole 10 concentrically traverses into the cylindrical body 9 and receives a tank system of the electronic vaping device. The first threaded shaft 11 connects to a battery case of the electronic vaping device and is positioned opposite the first threaded hole 10, along the cylindrical body 9. Additionally, the first threaded shaft 11 is connected concentric and adjacent to the cylindrical body 9. The external threaded portion 12 is a helical thread which attaches the cylindrical body 9 to the handle bridge 4. Thus, the external threaded portion 12 is sized and designed to engage and mesh with the internal threaded portion 7. The external threaded portion 12 is positioned in between the first threaded hole 10 and the first threaded shaft 11. Additionally, the external threaded portion 12 is laterally connected about the cylindrical body 9. One of the most important aspects of the coupling adaptor 8 is that the first threaded hole 10 and the first threaded shaft 11 are electrically connected to each other, thus allowing the battery case to supply electricity to the tank system. The coupling adaptor 8 may also include a gripping lip. The gripping lip is an annular lip attached to the cylindrical body 9 which provides a grasping element for the user.

Figure 2:
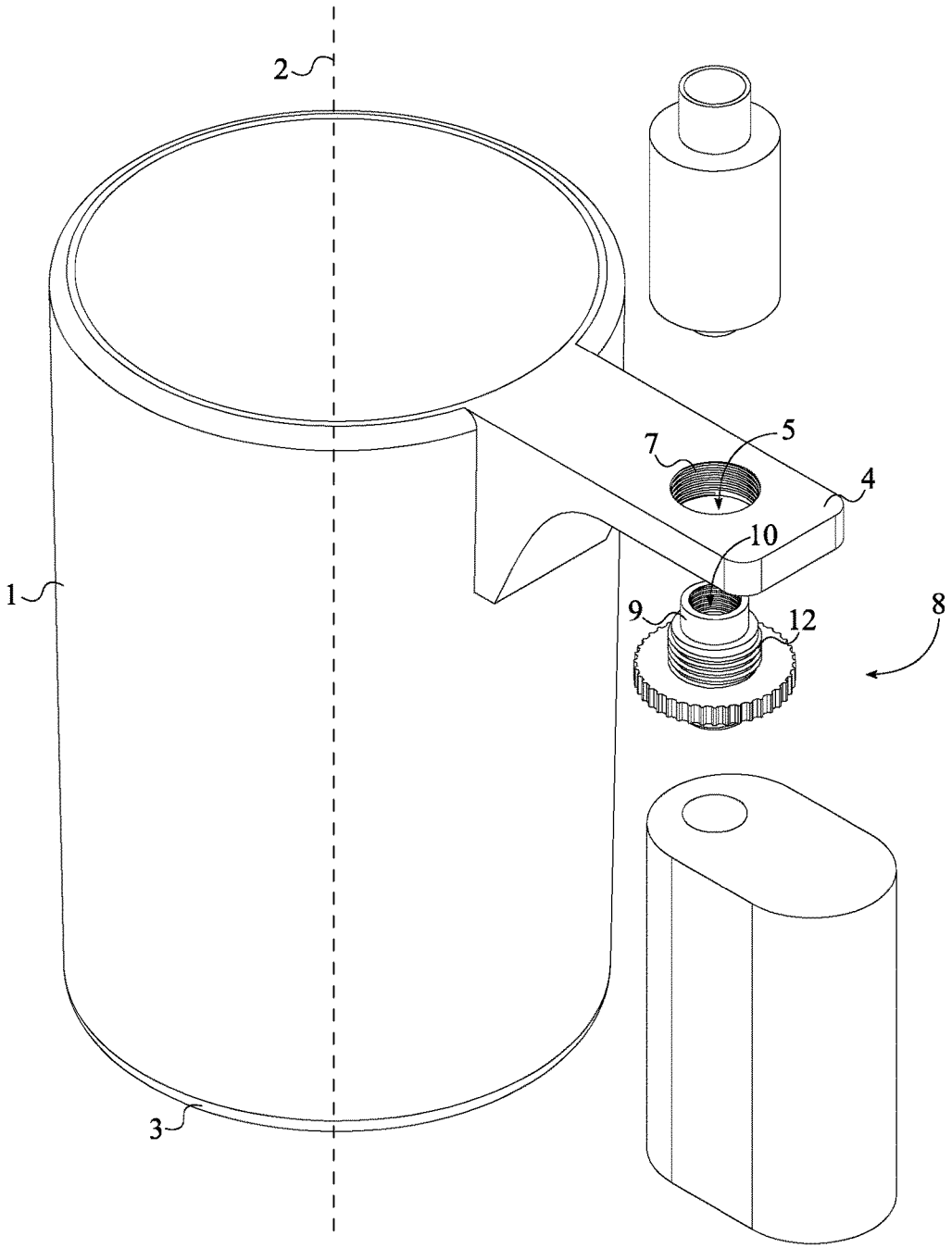
FIG. 2 is an exploded perspective view of the present invention.

Referring to FIG. 2, in order to mount the electric vaping device, first, the cylindrical body 9 is positioned within the mounting hole 5 with the external threaded portion 12 being threadably engaged to the internal threaded portion 7. Next, the tank system is screwed into the first threaded hole 10. Finally, the first threaded shaft 11 is screwed into the battery case. This adequately secures the electric vaping device to the coupling adaptor 8 and, therefore, the handle bridge 4. The electric vaping device is also fully functional due to the electric connection between the first threaded hole 10 and the first threaded shaft 11.

Figure 3:
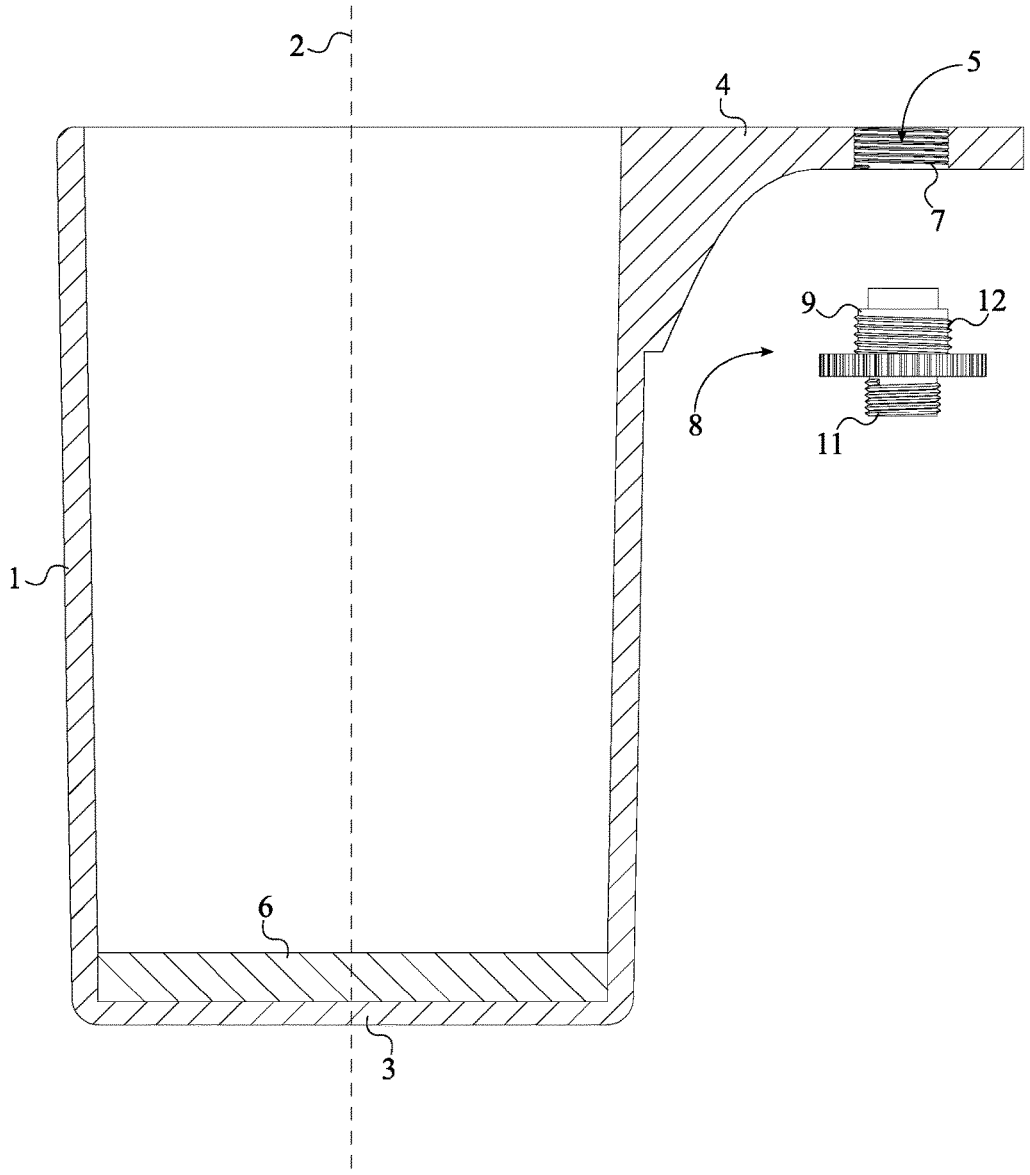
FIG. 3 is a partial sectional cut view of the present invention.

Referring to FIG. 3, in the preferred embodiment, the present invention further comprises a weighted plate 6. The weighted plate 6 ensures that the present invention stays upright when rested on a surface. This is especially important when the electronic vaping device is mounted and no liquid is present in the beverage container 1 as, in this instance, the weight of the electronic vaping device may tip the beverage container 1 over to one side. More specifically, the weighted plate 6 is positioned adjacent to the base 3 of the beverage container 1 and is centrally mounted to the base 3 of the beverage container 1. The weighted plate 6 may be connected to a bottom surface of the base 3 or a top surface of the base 3. Furthermore, in an alternative embodiment of the present invention, the weighted plate 6 may be integrated into the base 3 of the beverage container 1.

Figure 4:
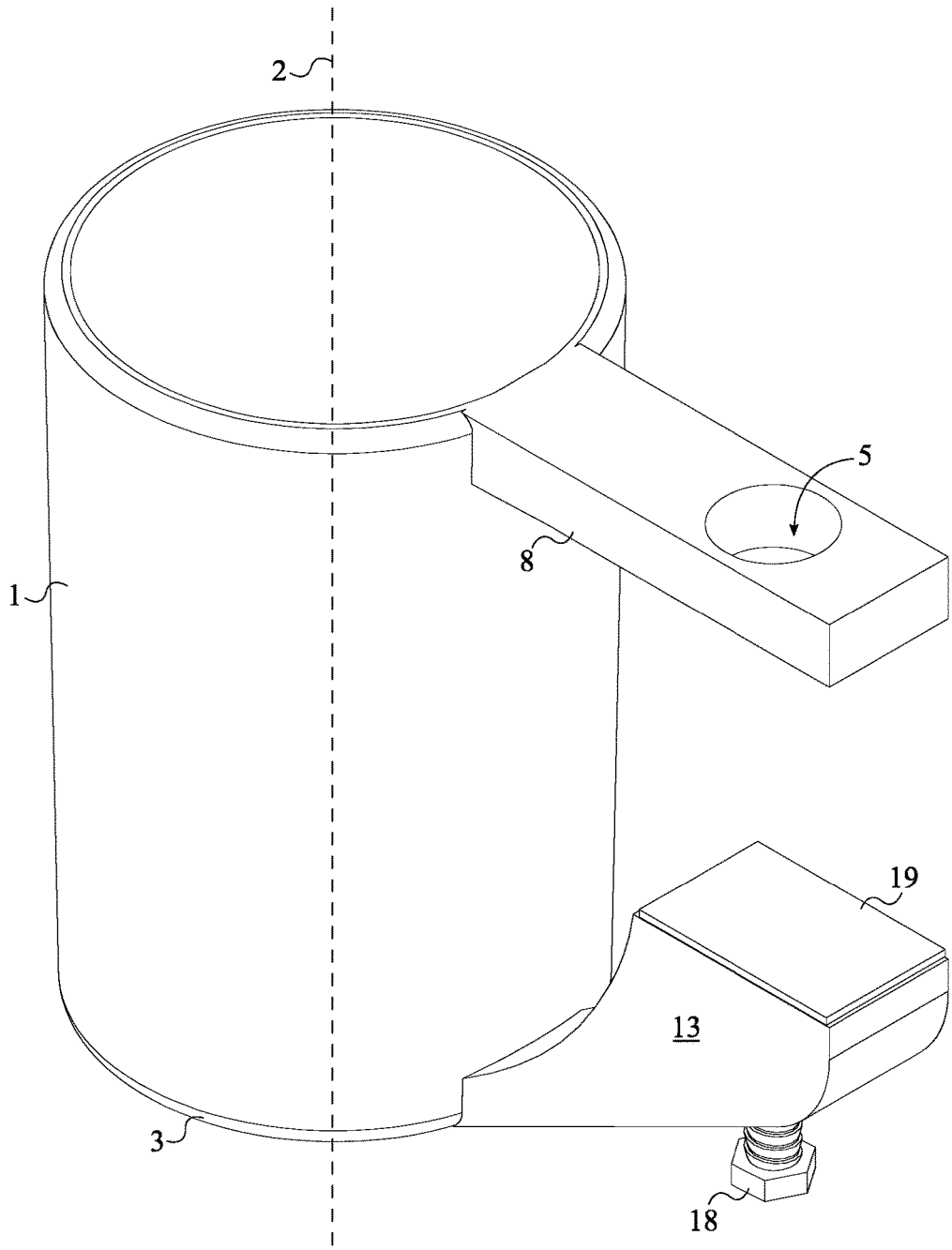
FIG. 4 is a perspective view of an alternative embodiment of the present invention.
Figure 5:
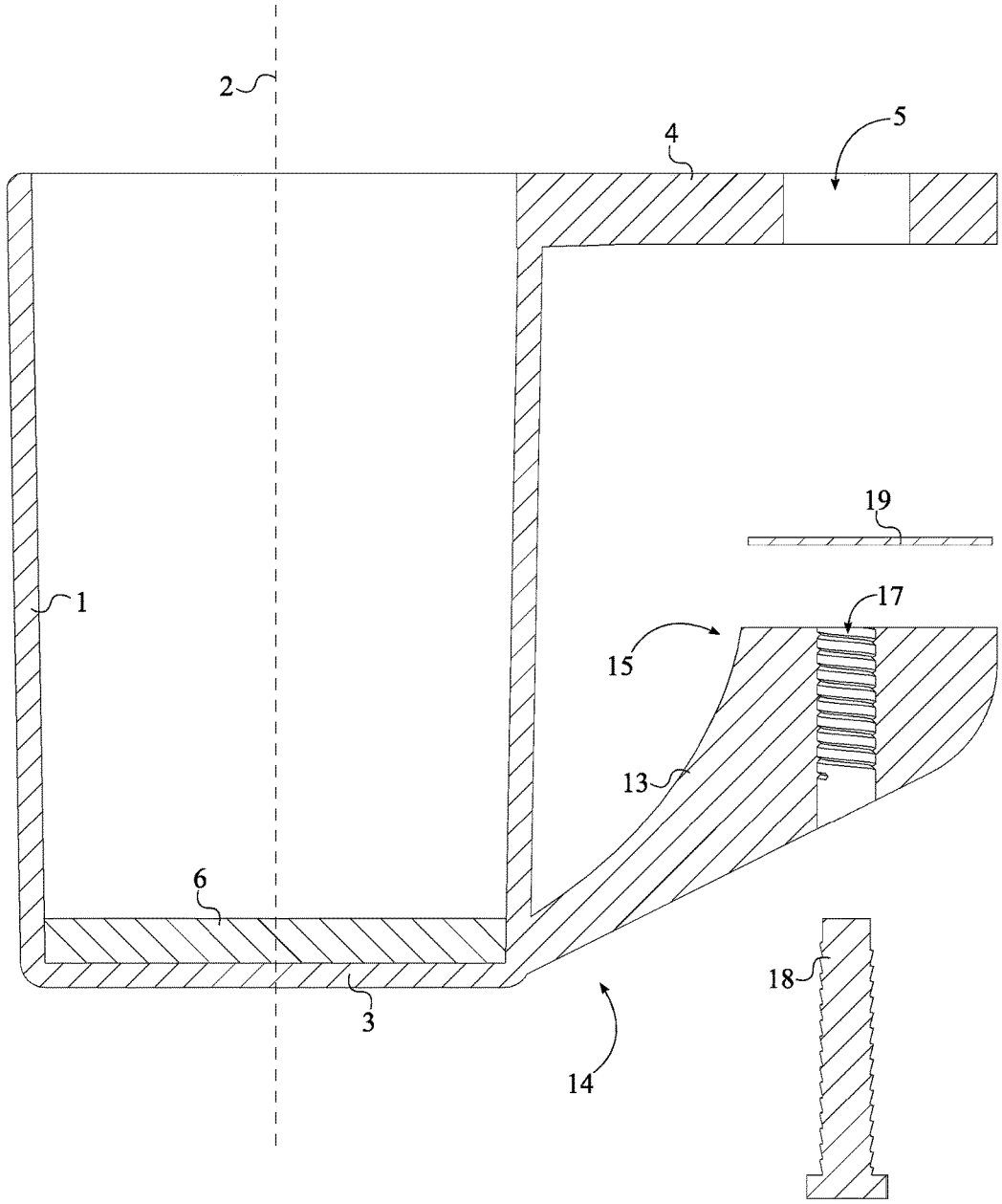
FIG. 5 is a sectional cut view of the alternative embodiment of the present invention.

Referring to FIG. 4 and FIG. 5, in an alternative embodiment, the electric vaping device is mounted to the handle bridge 4 through a handle body 13, a second threaded hole 17, a second threaded shaft 18, and an engagement plate 19. The handle body 13 provides a mounting point for the electric vaping device and provides an additional grasping point for the user's hand. Similar to traditional cup designs, a first end 14 of the handle body 13 is laterally connected to the beverage container 1, adjacent to the base 3 of the beverage container 1. A second end 15 of the handle body 13 is positioned adjacent to the handle bridge 4. The space between the handle body 13 and the handle bridge 4 receives the electric vaping device. This ensures that the present invention may receive a variety of different battery case designs and shapes.

In order to mount the electronic vaping device, the user simply puts the tank system through the mounting hole 5 and positions the battery case on top of the handle body 13. The second threaded hole 17, the second threaded shaft 18, and the engagement plate 19 act as a clamping mechanism to secure the electronic vaping device within the handle body 13. The second threaded hole 17 is positioned concentric with the mounting hole 5 and traverses through the handle body 13. The second threaded shaft 18 is concentrically and threadably engaged with the second threaded hole 17 in order to press against the bottom half of the battery case through the engagement plate 19. The engagement plate 19 is positioned adjacent to the second end 15 of the handle body 13 and is terminally connected to the second threaded shaft 18. Rotating the second threaded shaft 18 raises and lowers the second threaded shaft 18 and the engagement plate 19, thus securing or releasing the battery case within the second threaded hole 17.

In alternative embodiments of the present invention, alternative fastening and mounting mechanisms may be utilized in order to secure the electronic vaping device to the beverage container 1. Magnetic fasteners, tabular extensions, slots, cuts, or openings disposed on the exterior surface of the beverage container 1 may be utilized to engage the electronic vaping device. In yet another possible embodiment, a selectively opening lid may be used to allow selective dispensing of liquid beverage. A spout or an opening may dispense the beverage at discrete angular orientation, while keeping the beverage secure within the beverage container 1 in other angular orientations. A horizontally oriented elongate slot disposed on the selectively opening lid may hold the electronic vaping device therein.

In one embodiment, the present invention comprises electrical components utilized to add functionality to the present invention. A conventional printed circuit board disposed in the beverage container 1 may control the electrical components contained thereon and of the electric vaping device. The conventional printed circuit board may utilize components and arrangement well known in the relevant fields, such as resistors, potentiometers, capacitors, inductors, crystals, oscillators, relays, transformers, batteries, fuses, diodes, transistors, bridge rectifiers, integrated circuits, microcontrollers, switches, LEDs and LED displays, piezo buzzers, piezo elements, electret condenser microphone capsules, USB ports, and memory chips. A battery compartment in electrical communication with the port, holding a rechargeable battery therein, may provide power to the electronic vaping device. In order to operate this function, the user would simply plug in the USB charger available in conventional electronic vaping devices to the USB port. A manual actuating device such as a button in operable communication with the printed circuit board may be used to activate the electronic vaping device. It is also conceivable that a near field communication device disposed on the exterior surface of the beverage container 1 may be utilized to wirelessly recharge the electronic vaping device.

In regard to the materials utilized for the present invention, the preferred embodiment of the present invention is composed mainly of metallic and polymeric materials. However, it is easily conceivable that in possible alternate embodiments, each component may be made of a particular material specifically suited to withstand the structural loads and thermal conditions associated with normal and extraneous operating conditions. Additionally, it is easily conceivable to those having ordinary skills in the relevant arts, that metals, glass, biodegradable, and/or composite materials may also be utilized.

In one embodiment, the present invention further comprises a spill proof lid. The spill proof lid attaches to the beverage container 1 in order to allow the user to close the beverage container 1 and prevent spillage. Additionally, the spill proof lid includes a gate which slides over a main opening in order to easily allow the user to drink from the beverage container 1. This ensures that when the user is utilizing the electronic vaping device that the liquid within the beverage container 1 does not spill.

Although the invention has been explained in relation to its preferred embodiment, it is to be understood that many other possible modifications and variations can be made without departing from the spirit and scope of the invention as hereinafter claimed.

What is claimed is:

1. A beverage container accessory for an electronic vaping device comprises:

a beverage container;

a handle bridge;

a mounting hole;

a weighted plate;

the handle bridge being positioned offset from a base of the beverage container;

the handle bridge being laterally connected to the beverage container;

the weighted plate being positioned adjacent to the base of the beverage container;

the weighted plate being centrally mounted to the base of the beverage container;

the mounting hole traversing through the handle bridge;

the mounting hole being positioned parallel to a central axis of the beverage container; and the mounting hole being positioned offset from the beverage container.

2. The beverage container accessory for an electronic vaping device as claimed in claim 1 comprises:

an internal threaded portion;

the internal threaded portion being positioned within the mounting hole; and the internal threaded portion being laterally connected to the handle bridge, about the mounting hole.

3. The beverage container accessory for an electronic vaping device as claimed in claim 1 comprises:

an internal threaded portion;

a coupling adaptor;

the coupling adaptor comprises a cylindrical body, a first threaded hole, a first threaded shaft, and an external threaded portion;

the internal threaded portion being positioned within the mounting hole;

the internal threaded portion being laterally connected to the handle bridge, about the mounting hole;

the first threaded hole concentrically traversing into the cylindrical body;

the first threaded shaft being positioned opposite the first threaded hole, along the cylindrical body;

the first threaded shaft being connected concentric and adjacent to the cylindrical body;

the external threaded portion being positioned in between the first threaded hole and the first threaded shaft;

the external threaded portion being laterally connected about the cylindrical body;

the cylindrical body being concentrically positioned within the mounting hole; and the external threaded portion being threadably engaged to the internal threaded portion.

4. The beverage container accessory for an electronic vaping device as claimed in claim 3, wherein the first threaded hole and the first threaded shaft are electrically connected to each other.

5. The beverage container accessory for an electronic vaping device as claimed in claim 1 comprises:

a handle body;

a first end of the handle body being laterally connected to the beverage container, adjacent to the base of the beverage container; and a second end of the handle body being positioned adjacent to the handle bridge.

6. The beverage container accessory for an electronic vaping device as claimed in claim 5 comprises:

a second threaded hole;

a second threaded shaft;

an engagement plate;

the second threaded hole being positioned concentric with the mounting hole;

the second threaded hole traversing through the handle body;

the second threaded shaft being concentrically and threadably engaged with the second threaded hole;

the engagement plate being positioned adjacent to the second end of the handle body; and the engagement plate being terminally connected to the second threaded plate.

7. A beverage container accessory for an electronic vaping device comprises:

a beverage container;

a handle bridge;

a mounting hole;

a weighted plate;

an internal threaded portion;

the handle bridge being positioned offset from a base of the beverage container;

the handle bridge being laterally connected to the beverage container;

the weighted plate being positioned adjacent to the base of the beverage container;

the weighted plate being centrally mounted to the base of the beverage container;

the mounting hole traversing through the handle bridge;

the mounting hole being positioned parallel to a central axis of the beverage container;

the mounting hole being positioned offset from the beverage container;

the internal threaded portion being positioned within the mounting hole; and the internal threaded portion being laterally connected to the handle bridge, about the mounting hole.

8. The beverage container accessory for an electronic vaping device as claimed in claim 7 comprises:

a coupling adaptor;

the coupling adaptor comprises a cylindrical body, a first threaded hole, a first threaded shaft, and an external threaded portion;

the first threaded hole concentrically traversing into the cylindrical body;

the first threaded shaft being positioned opposite the first threaded hole, along the cylindrical body;

the first threaded shaft being connected concentric and adjacent to the cylindrical body;

the external threaded portion being positioned in between the first threaded hole and the first threaded shaft;

the external threaded portion being laterally connected about the cylindrical body;

the cylindrical body being concentrically positioned within the mounting hole; and the external threaded portion being threadably engaged to the internal threaded portion.

9. The beverage container accessory for an electronic vaping device as claimed in claim 8, wherein the first threaded hole and the first threaded shaft are electrically connected to each other.

10. A beverage container accessory for an electronic vaping device comprises:

a beverage container;

a handle bridge;

a mounting hole;

a weighted plate;

a handle body;

the handle bridge being positioned offset from a base of the beverage container;

the handle bridge being laterally connected to the beverage container;

the weighted plate being positioned adjacent to the base of the beverage container;

the weighted plate being centrally mounted to the base of the beverage container;

the mounting hole traversing through the handle bridge;

the mounting hole being positioned parallel to a central axis of the beverage container;

the mounting hole being positioned offset from the beverage container;

a first end of the handle body being laterally connected to the beverage container, adjacent to the base of the beverage container; and a second end of the handle body being positioned adjacent to the handle bridge.

11. The beverage container accessory for an electronic vaping device as claimed in claim 10 comprises:

a second threaded hole;

a second threaded shaft;

an engagement plate;

the second threaded hole being positioned concentric with the mounting hole;

the second threaded hole traversing through the handle body;

the second threaded shaft being concentrically and threadably engaged with the second threaded hole;

the engagement plate being positioned adjacent to the second end of the handle body; and the engagement plate being terminally connected to the second threaded plate.

* * * * *